US010399770B2

(12) United States Patent
Antal

(10) Patent No.: US 10,399,770 B2
(45) Date of Patent: Sep. 3, 2019

(54) TRASH CAN ASSEMBLY AND METHOD OF USE

(71) Applicant: Zsombor Antal, River Edge, NJ (US)

(72) Inventor: Zsombor Antal, River Edge, NJ (US)

( * ) Notice: Subject to any disclaimer, the term of this patent is extended or adjusted under 35 U.S.C. 154(b) by 14 days.

(21) Appl. No.: 15/627,682

(22) Filed: Jun. 20, 2017

(65) Prior Publication Data

US 2017/0362024 A1 Dec. 21, 2017

Related U.S. Application Data

(60) Provisional application No. 62/352,073, filed on Jun. 20, 2016.

(51) Int. Cl.
*B65F 1/08* (2006.01)
*B65F 1/06* (2006.01)

(52) U.S. Cl.
CPC ..... *B65F 1/08* (2013.01); *B65F 1/06* (2013.01); *B65F 2210/188* (2013.01)

(58) Field of Classification Search
CPC ..... B65F 1/06; B65F 1/08
See application file for complete search history.

(56) References Cited

U.S. PATENT DOCUMENTS 5,295,606 A * 3/1994 Karwoski ..... B65F 1/06 220/4.01
5,388,717 A * 2/1995 LeVasseur ..... B65F 1/068 220/495.06
7,273,155 B1 * 9/2007 Gray ..... B65F 1/06 220/495.04

* cited by examiner

*Primary Examiner* — Andrew T Kirsch
(74) *Attorney, Agent, or Firm* — John H. Choi & Associates

(57) ABSTRACT

A trash can assembly and method of use. An inner can has a first space and includes a first inner seal circumscribing an outer surface of the inner can, an inner opening and an inner valve configured to close and expose the inner opening. A trash bag is positioned within the first space and coupled to the inner can to form a substantially air-tight seal between the trash bag and the inner can. An outer can having a second space includes an outer opening and an outer valve configured to close and expose the outer opening. The inner can is positioned within the second space. The first inner seal is configured to form a substantially air-tight seal between the first inner seal and the outer can. The inner valve is closed when the outer valve is opened, and the inner valve is opened when the outer valve is closed.

20 Claims, 7 Drawing Sheets

TRASH CAN ASSEMBLY AND METHOD OF USE

CROSS-REFERENCE TO RELATED APPLICATION

This application claims priority to U.S. Provisional Application No. 62/352,073, filed on Jun. 20, 2016, which is incorporated by reference in its entirety.

BACKGROUND OF THE INVENTION

1. Field of the Invention

The present invention relates to a trash can, and in particular to a trash can assembly which utilizes a vacuum effect to insert and maintain a trash bag therein with maximum capacity.

2. Description of Prior Art

In the prior art, trash bags are used to line a trash can, and after removal of a filled or partially-filled trash bag from the trash can, the trash can is refilled with a new trash bag. The prior art method of changing the trash bag involves manually trying to open or expand a new trash bag prior to insertion into the empty trash can. To manually open the new trash bag, which is typically composed of plastic, a user tries separating the folds or surfaces of the trash bag, which typically stick together due to static electricity and/or suction effects due to their plastic composition. A user of the new trash bag in the prior art typically swings the bag around or up and down, trying to catch air in it to overcome the static electricity and/or suction effects, and thus to fill the new bag with air. The newly expanded trash bag is then placed into the trash can. In the prior art, many people leave the trash bag in the trash can, while other people reach into the bag in the trash can and then try to push the bag around the walls of the trash can to maximize the capacity of the new trash bag.

Still other users in the prior art attempt to fold the edges of the new trash bag over the upper rim of the trash can, while attempting to keep the new trash bag in expanded form and without the surfaces of the trash bag being attracted to each other again by static electricity and/or suction effects. Many people dislike this cumbersome process of expanding the new trash bag for insertion into a trash can.

Another common problem in the prior art is that air is trapped between the outer surface of the trash bag and the inner surface of the trash can, reducing the usable capacity of the trash bag. As the bottom of the bag is filled with rubbish the trapped air travels upward and the space between the outer side walls of the trash bag and the inner side walls of the trash can is expanded. Thus, not only is the usable capacity of the trash bag reduced but the additional pressure is exerted on the trash bag, risking a tear in the trash bag.

Therefore, a need exists for a trash can assembly and method of using the same that would enable a user to easily install a trash bag to a trash can to its maximum capacity.

OBJECTS AND SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In general, the present invention provides a trash can assembly capable of solving the problems associated with prior art trash cans described above. More specifically, the current trash can assembly provides a means to eliminate air trapped between the outer surface of the trash bag and the inner surface of the trash can. The present invention also provides a method of performing that function.

Thus, in one aspect, the present invention provides a trash can assembly, comprising: an inner can having a first space therewithin, the inner can having a first inner seal circumscribing an outer surface of the inner can, the inner can having an inner opening; an inner valve, the inner valve configured to close and expose the inner opening; a trash bag configured to be positioned within the first space, the trash bag operably coupled to the inner can such that a substantially air-tight seal is formed between the trash bag and the inner can; an outer can having a second space therein, the inner can configured to be positioned within the second space, the outer can having an outer opening; and an outer valve, the outer valve configured to close and expose the outer opening; wherein the first inner seal is configured such that a substantially air-tight seal is formed between the first inner seal and the outer can wherein the inner valve is closed when the outer valve is opened, and the inner valve is opened when the outer valve is closed.

In another aspect, the present invention provides a trash can assembly, comprising: an inner can having a first space therewithin, the inner can having a first inner seal circumscribing an outer surface of the inner can, the inner can having a inner opening; and an outer can having a second space therein, the inner can configured to be positioned within the second space, the outer can having an outer opening; wherein the first inner seal is configured such that a substantially air-tight seal is formed between the first inner seal and the outer can.

In yet another aspect, the present invention provides a method of using a trash can assembly, comprising the steps of: positioning a trash bag within a first space of an inner can such that a substantially air-tight seal is formed between the trash bag and the inner can, the inner can comprising: a first inner seal circumscribing an outer surface of the inner can, an inner opening exposing the first space, and an inner valve configured to close and expose the inner opening; and positioning the inner can substantially completely within a second space of an outer can, the outer can comprising: an outer opening, and an outer valve, the outer valve configured to close and expose the outer opening; wherein the first inner seal is configured such that a substantially air-tight seal is formed between the first inner seal and the outer can; and wherein the inner valve is closed when the outer valve is opened, and the inner valve is opened when the outer valve is closed.

BRIEF DESCRIPTION OF THE DRAWINGS

The foregoing summary, as well as the following detailed description of presently preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

Figure 3:
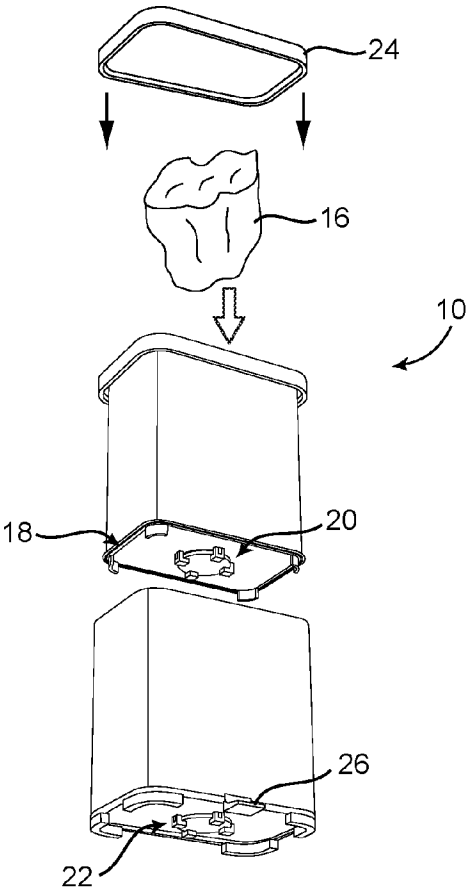
FIG. 3 is a bottom front side perspective view of the trash can assembly with parts separated.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION OF THE PREFERRED EMBODIMENTS

Certain terminology is used in the following description for convenience only and is not limiting. The article "a" is intended to include one or more items, and where only one item is intended the term "one" or similar language is used. Additionally, to assist in the description of the present invention, words such as top, bottom, upper, lower, front, rear, inner, outer, right and left are used to describe the accompanying figures. The terminology includes the words above specifically mentioned, derivatives thereof, and words of similar import.

Figure 1:
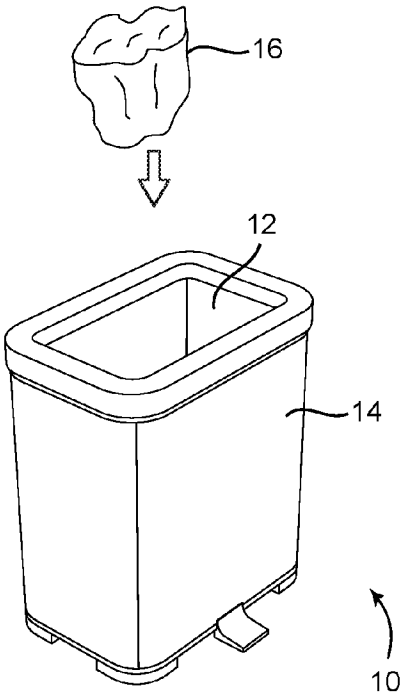
FIG. 1 is a top front side perspective view of the trash can assembly in a first configuration.

The vacuum trash can assembly 10 and method of use are described herein with reference to FIGS. 1-13. FIG. 1 is a top front side perspective view of the trash can assembly 10 in a first configuration, in which an inner can 12 having a first space is stored in an outer can 14 within a second space therein, and a trash bag 16 is to be inserted into the inner can 12 within the first space. The inner can 12 and the outer can 14 form a double wall trash can which uses a vacuum effect created by the mechanical pulling up of the inner can 12 to expand the trash bag 16.

Figure 2:
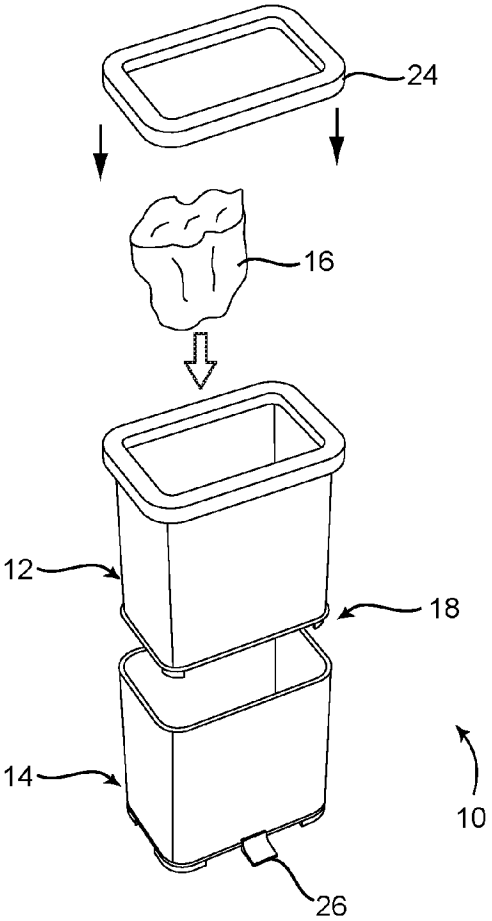
FIG. 2 is a top front side perspective view of the trash can assembly with parts separated.

Both of the cans 12, 14 may be composed of plastic, such as known polymer materials. FIG. 2 is a top front side perspective view of the vacuum trash can assembly with parts separated, and FIG. 3 is a bottom front side perspective view of the vacuum trash can assembly with parts separated. The inner can 12 has a first inner seal 18, such as a silicone ring, to create a seal between the inner can 12 and the outer can 14. The dimensions of the seal 18 are such that an air-tight seal is formed between the seal 18 and the inner dimension of the outer can 14. In the present embodiment, the seal 18 is positioned at a bottom section of the inner can 12 but the seal 18 could be positioned on any section of an outer surface of the inner can 12. The material and dimensions of the seal 18 are such that while forming an air-tight seal, the user is able to move the inner can 12 up and down within the outer can 14 without use of excessive force. Furthermore, the seal 18 could be constructed of a flexible material to accommodate for difference tolerances between the inner and outer cans 12, 14. A second inner seal or top rim 24 is removably mounted on the upper rim or edge of the inner can 12. The second inner seal 24 could also be an adhesive, permanent or multi-use, positioned on an upper portion of the inner can 12 or anywhere along the outer surface of the inner can 12. An edge 26, in the form of a pedal or lip, is formed on the bottom surface of the outer can 14. The edge 26 is used to secure the outer can 14 when the user engages the inner can 12, as will be described in more detail below.

Referring to FIGS. 9-13, both cans 12, 14 have a one-way valve, or inner valve 20 and outer valve 22, on their respective bottom surfaces, and each valve 20, 22 may be composed of plastic, or composed of a simple silicone plate or flap inserted into a cage that will act as a valve when the inner can 12 is either lifted or pushed downward relative to the outer can 14.

Figure 8:
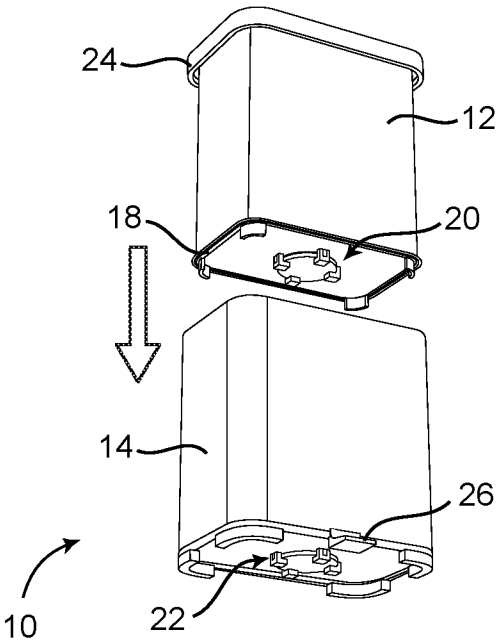
FIG. 8 is a bottom front side perspective view of the trash can assembly in the fourth configuration.
Figure 10:
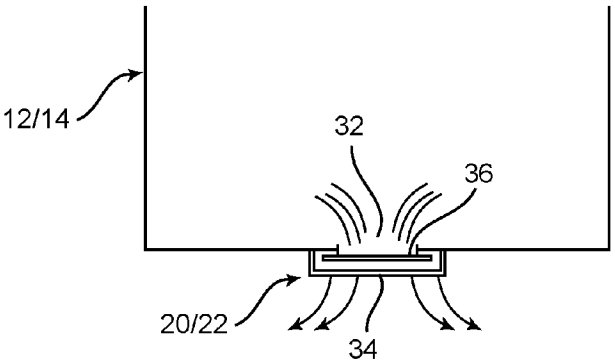
FIG. 10 is a side view of the can of FIG. 9 showing the one-way valve in an unsealed configuration.
Figure 9:
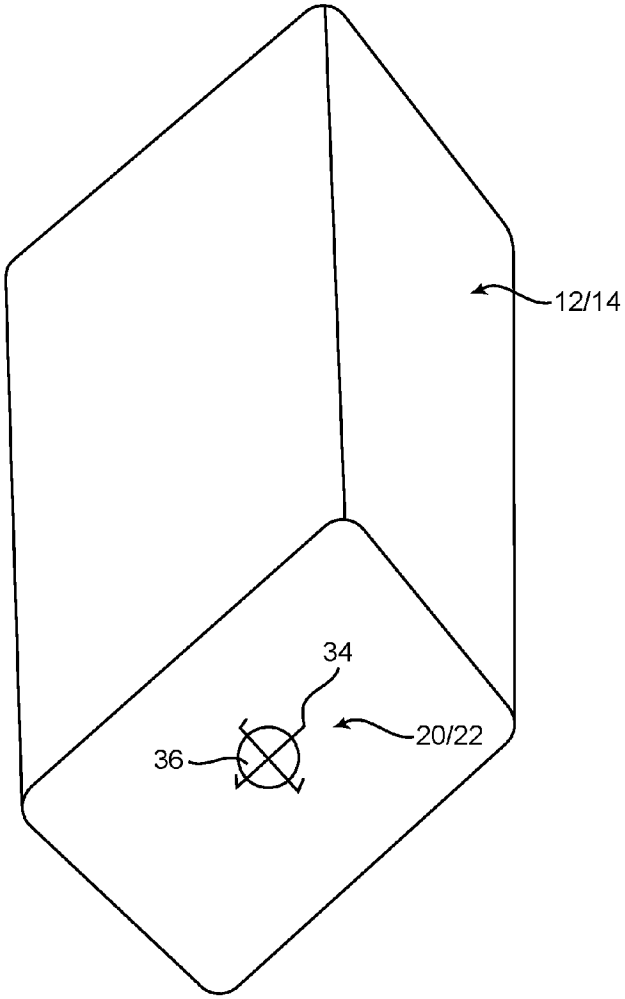
FIG. 9 is bottom perspective view of inner and outer cans of the trash can assembly of the present invention showing an embodiment of a one-way valve of the present invention.

As shown in FIGS. 3, 6 and 8-10, the inner and outer cans 12, 14 each have an opening 32, or inner opening and outer opening, respectively, at a bottom portion thereof. In this embodiment, the opening is circular but other shapes and sizes could be used as well. In one embodiment, as shown in FIGS. 9 and 10, the opening 32 is circumscribed with a protective member 34 extending downward on a bottom portion of the cans 12, 14. Here, the protective member 34 includes two intersecting plastic ribs integrally formed with the cans 12, 14 by injection molding. However, the ribs are constructed of other materials and attached to the cans 12, 14 by other means. For example, the ribs could be of a metal material and inserted via notches or detents formed on a bottom portion of the cans 12, 14. In between the protective member 34 and the can 12, 14 is a sealing member 36. In this embodiment, the sealing member 36 is circular in shape and larger in diameter than the opening 32. The sealing member 36 is semi-rigid and could be constructed of silicone or rubber. Other materials could be used to construct the sealing member 36 as well, for example, other thin, light-weight plastics or metals. Thus, in this embodiment, each valve 20, 22 includes the protective member 34 and sealing member 36. In another embodiment, as shown in FIGS. 3, 6, 8 and 13, the protective member 34 includes a plurality of extensions 54 which are independent from each other but configured to house the sealing member 36.

Figure 12:
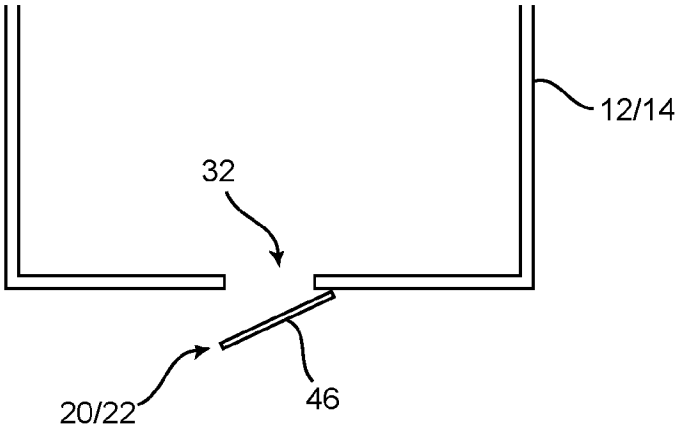
FIG. 12 is a side view of the can of FIG. 11 in an unsealed configuration.
Figure 11:
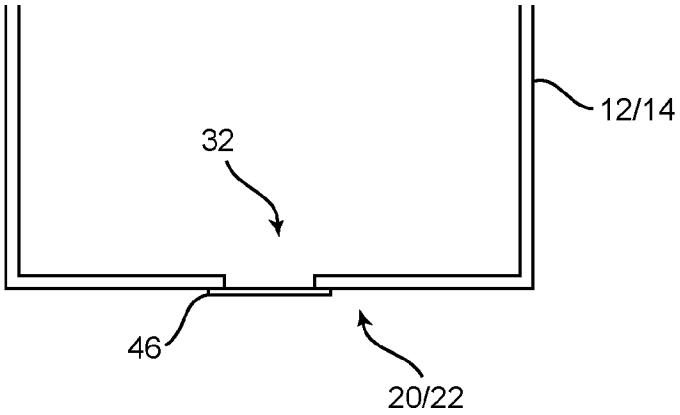
FIG. 11 is a side view of the inner and outer cans of the trash can assembly of the present invention showing another embodiment of a one-way valve of the present invention in a sealed configuration.
Figure 13:
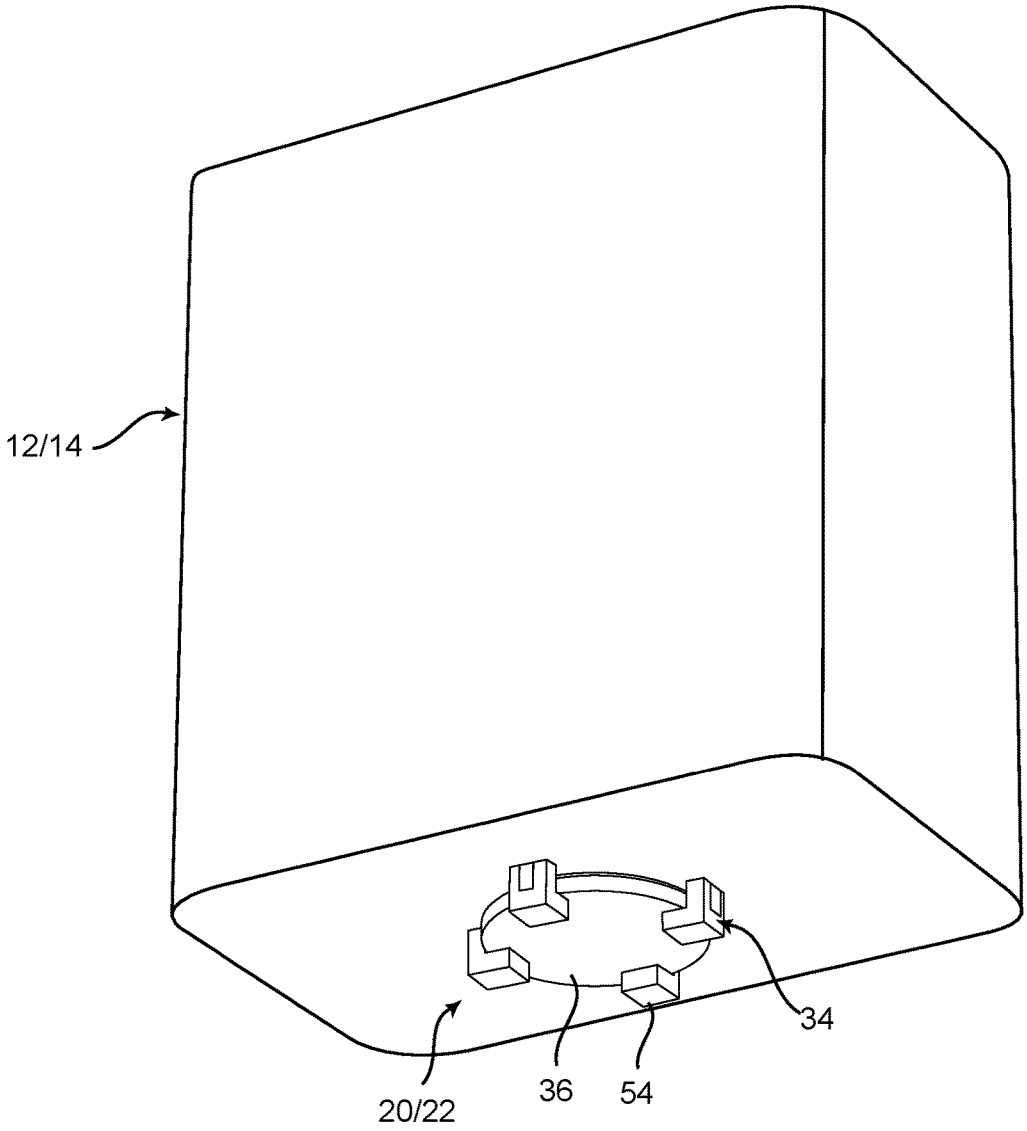
FIG. 13 is a bottom perspective view of inner and outer cans of the trash can assembly of the present invention showing another embodiment of a one-way valve of the present invention.

In another embodiment, as shown in FIGS. 11 and 12, the cans 12, 14 include an opening 32 as described above. The bottom portion of the can 12, 14 includes a sealing member 46 that is pivotally coupled to the can 12, 14 and sufficiently large to cover the opening 32. In this embodiment, the sealing member 46 is a semi-rigid flap constructed of silicone or rubber which is normally flat in a rested state. That is, when no force or pressure is applied to the sealing member 46, the flap covers the opening 42. However, when a force or pressure is applied, i.e. force from compressed air, the sealing member 46 is pivotally displaced downward. Other materials could be used to construct the sealing member 46 as well, for example, other thin, light-weight plastics or metals. Thus, in this embodiment, each valve 20, 22 includes the protective sealing member 46.

One of ordinary skill in the art would recognize by the current disclosure that either can 12, 14 could take on either of the embodiments of the valves 20, 22 described above, whether identical or in combination.

Figure 4:
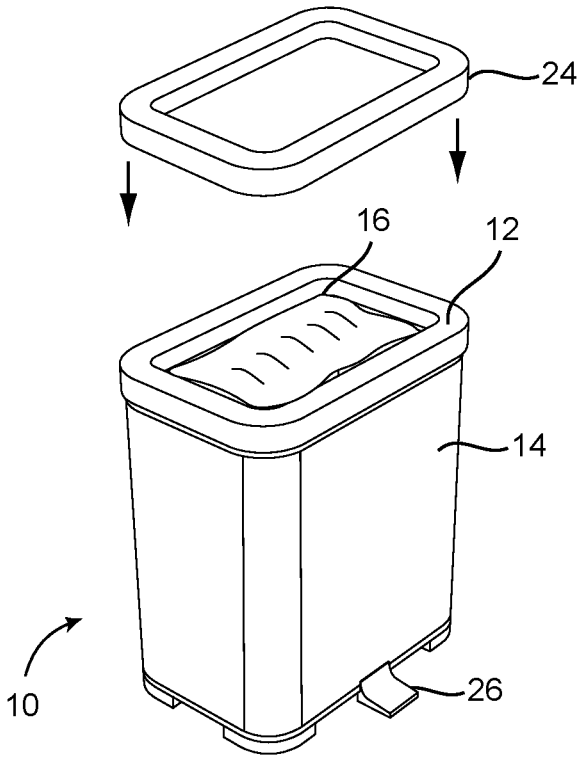
FIG. 4 is a top front side perspective view of the trash can assembly in a second configuration.

FIG. 4 is a top front side perspective view of the trash can assembly 10 in a second configuration, with the new trash bag 16 loosely positioned within the inner can 12, prior to expansion of the new trash bag 16 as described herein with reference to FIGS. 5-8. When changing the trash bag 16 with the disclosed vacuum can assembly 10, the user simply places the new trash bag 16 in the inner can 12, and stretches the edges or open end of the bag 16 over the top edge of the inner can 12, in the same manner as in the prior art.

As shown in FIG. 4, in the present invention, the top rim 24 is then placed on the top edge of the inner can 12 with the edge of the trash bag 16 positioned therebetween, and top rim 24 is secured into place, for example, by a friction fit, which will secure and seal the bag 16 to the top edge of the inner can 12, and which also presents an aesthetically pleasing appearance of the top rim 24 as shown in FIGS. 5-8, as opposed to presenting the exposed surfaces of the bag 16 as in the prior art. In another embodiment, the trash bag 16 is secured to the inner can 12 in a substantially air-tight manner by an elastic means such as a rubber band. In this configuration, the user is capable of securing the trash bag 16 on any section of the inner can depending on preference and the length of the excess material of the trash bag 16 hanging over the inner can 12. In the second configuration shown in FIG. 4, the bag 16 is stretched around the top edge of the inner can 12, but the bag 16 is not fully opened or expanded within the interior of the inner can 12, and the bag 16 is not fully lined with the inner surface of the inner can 12.

Figure 6:
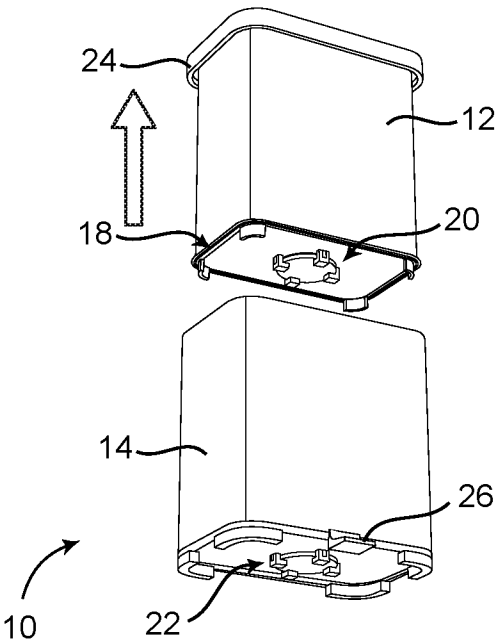
FIG. 6 is a bottom front side perspective view of the vacuum trash can assembly in the third configuration.
Figure 5:
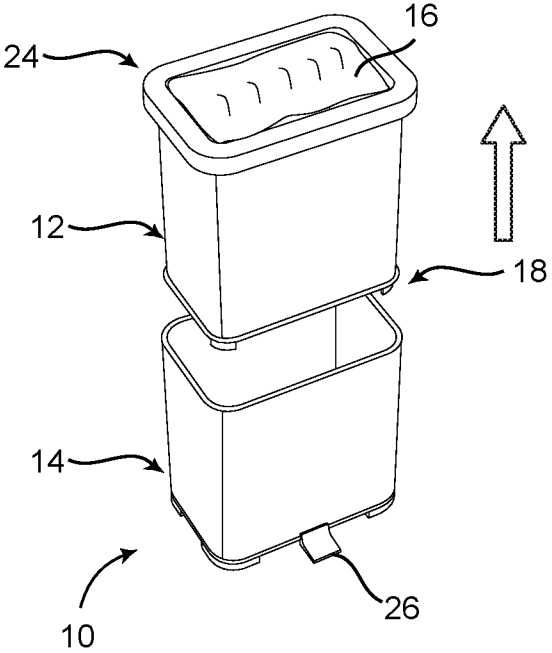
FIG. 5 is a front side perspective view of the trash can assembly in a third configuration.

FIG. 5 is a front side perspective view of the vacuum trash can assembly 10 in a third configuration, and FIG. 6 is a bottom front side perspective view of the vacuum trash can assembly 10 in the third configuration, and is shown in this manner for illustrative purposes only. As shown in FIGS. 5-6, the user steps on the bottom lip 26 of the outer can 14 to temporarily secure the outer can 14 to the floor, and the user then pulls upward on the combination of the inner can 12, trash bag 16, and top rim 24. Again, it is to be understood that FIGS. 5-6 are shown this way for purposes of clarity and that the inner can 12 is actually not fully removed from the outer can 14 in the steps shown in FIGS. 5-6.

Such upward pulling of the inner can 12 relative to the outer can 14 exchanges the air trapped within the first space of the inner can 12 through the inner valve 20, and such air from between the inner can 12 and trash bag 16 is transferred to the bottom of the now-opened volume of the interior of the outer can 14 or second space, in a manner similar to the pull of a syringe exchanging air and/or fluids. That is, in the embodiments of the one-way valves 20, 22 shown in FIGS. 9, 10 and 13, the sealing member 36 of the inner can 12 is displaced downward to expose the opening 32 of the inner can 12, while the sealing member 36 of the outer can 14 is displaced upward to seal the opening of the outer can 14. Similarly, in the embodiment of the one-way valve 20, 22 shown in FIGS. 11 and 12, the sealing member 46 of the inner can 12 is displaced downward to expose the opening 32 of the inner can 12, while the sealing member 46 of the outer can 14 is displaced upward to seal the opening 32 of the outer can 14.

The exchange of air between the inner can 12 and the outer can 14 creates a vacuum effect which stretches and expands the trash bag 16 such that the sides of the trash bag 16 are substantially adjacent to and/or abutting the inner side walls of the inner can 12, to instantly open the trash bag 16 to fill substantially equal to 100% of the interior volume of the inner can 12. The combination of the expanded bag 16 with the inner can 12 and top rim 24 is now in the third configuration.

Figure 7:
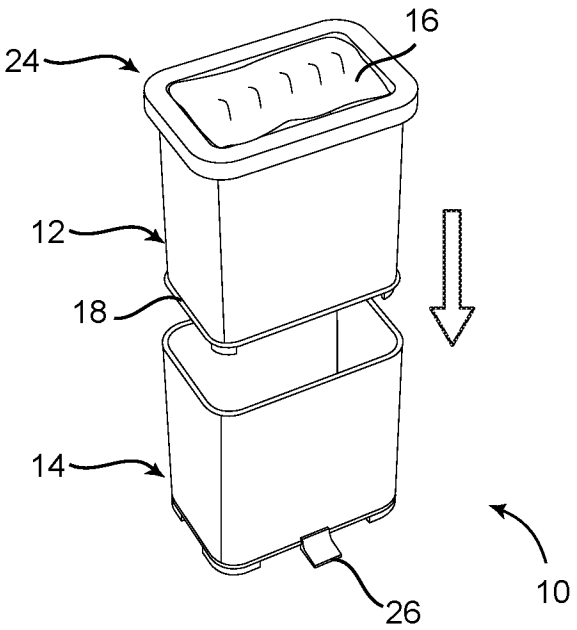
FIG. 7 is a top front side perspective view of the trash can assembly in a fourth configuration.

FIG. 7 is a top front side perspective view of the vacuum trash can assembly in a fourth configuration and FIG. 8 is a bottom front side perspective view of the vacuum trash can assembly in the fourth configuration, and is shown in the manner for illustrative purposes only. That is, the inner can 12 is not pulled out from the outer can 14, but it is shown this way for purposed of clarity. In this configuration, the user pushes the combination of the expanded bag 16, inner can 12, and top rim 24 downward into the interior of the outer can 14. By this movement, an upward force is exerted on the bottom portion of the inner can 12 and the one-way valve 20 thereof is closed. That is, in the embodiments of the one-way valves 20, 22 shown in FIGS. 9, 10 and 13, the sealing member 36 of the inner can 12 is displaced upward to close or seal the opening 32 of the inner can 12, while the sealing member 36 of the outer can 14 is displaced downward to expose the opening 32 of the outer can 14. Similarly, in the embodiment of the one-way valve 20, 22 shown in FIGS. 11 and 12, the sealing member 46 of the inner can 12 is displaced upward to close or seal the opening 32 of the inner can 12, while the sealing member 46 of the outer can 14 is displaced downward to expose the opening of the outer can 14.

Therefore, air is not able to migrate or flow back under the bag 16 and into the inner can 12, and thus the bag 16 will remain in the expanded configuration within the inner can 12. Instead, the air between the inner can 12 and the outer can 14 in the second space is pushed out of the bottom of the outer can 14 through the one-way valve 22 of the outer can 14 which is opened from a downward force exerted on the floor portion of the outer can 14.

Accordingly, with a simple pulling-up and pushing-down motion, the user creates a vacuum effect to create a substantially perfect lining of the trash can assembly 10 by the new bag 16 every time with minimal effort and time to perform such insertion of the bag 16. Therefore, fast and efficient changing of trash bags is performed, with full use of the capacity of the bag 16 being attained every time, with improved aesthetics of the trash can assembly 10.

The vacuum effect is attained manually by simple mechanical interactions by the relative motions of the cans 12, 14 using the one-way valves 20, 22. Alternatively, the present invention may be implemented electronically using an electronically created vacuum generated in the interior of the inner can 12. For example, an electric motor, powered by battery or electricity from an outlet, could be operably coupled to a fan and one-way valve on the inner can 12. In this fashion, air between the trash bag 16 and the inner can 12 is displaced from the inner can 12 outward toward the outer can 14. The one-way valve 22 of the outer can 14 is open and air is displaced into the atmosphere. The fan is turned off when the trash bag 16 is expanded and both one-way valves are closed. In this embodiment, the trash can assembly 10 could be assembled without the outer can 14.

Further accessories could be included in the trash can assembly 10. For example, a lid could be provided to cover the open end of the inner can 12. This could be accomplished with a completely removable lid or a lid hinged to the inner can 12 or the top rim 24 for pivotable movement.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A trash can assembly, comprising:

an inner can having a first space therewithin, the inner can having a first inner seal circumscribing an outer surface of the inner can, the inner can having an inner opening;

an inner valve, the inner valve configured to close and expose the inner opening;

a trash bag configured to be positioned within the first space, the trash bag operably coupled to the inner can such that a substantially air-tight seal is formed between the trash bag and the inner can;

an outer can having a plurality of vertical sides and a horizontal bottom plane, with the vertical sides and the horizontal bottom plane forming a second space therebetween, the inner can configured to be positioned within the second space, the horizontal bottom plane having a horizontal central region with an outer opening extending through the horizontal central region; and an outer valve horizontally oriented and positioned on the horizontal central region of the horizontal bottom plane, the outer valve configured to close and expose the outer opening;

wherein the first inner seal is configured such that a substantially air-tight seal is formed between the first inner seal and the outer can; and wherein the inner valve is closed when the outer valve is opened, and the inner valve is opened when the outer valve is closed.

2. The trash can assembly of claim 1, wherein at least one of the inner valve and the outer valve comprises a sealing member, the sealing member configured to be displaceable, the sealing member configured such that a respective opening is capable of being substantially covered therewith.

3. The trash can assembly of claim 2, wherein the sealing member is at least partially coupled to an outer surface of a respective can.

4. The trash can assembly of claim 2, wherein the sealing member being at least partially enclosed with a protective member such that the sealing member is positioned between a respective can and the protective member, the sealing member configured to be displaceable between the protective member and a respective can, the sealing member configured such that a respective opening is capable of being substantially covered therewith.

5. The trash can assembly of claim 1, further comprising:

a cage surrounding the outer opening and the outer valve.

6. A trash can assembly, comprising:

an inner can having a first space therewithin, the inner can having a first inner seal circumscribing an outer surface of the inner can, the inner can having an inner opening; and an outer can having a plurality of vertical sides and a horizontal bottom plane, with the vertical sides and the horizontal bottom plane forming a second space therebetween, the inner can configured to be positioned within the second space, the horizontal bottom plane having a horizontal central region with an outer opening extending through the horizontal central region;

wherein the first inner seal is configured such that a substantially air-tight seal is formed between the first inner seal and the outer can.

7. The trash can assembly of claim 6, further comprising an inner valve operably coupled to the inner opening and an outer valve operably coupled to the outer opening, wherein the inner valve is closed when the outer valve is opened, and the inner valve is opened when the outer valve is closed.

8. The trash can assembly of claim 7, wherein at least one of the inner valve and the outer valve comprises a sealing member, the sealing member configured to be displaceable, the sealing member configured such that a respective opening is capable of being substantially covered therewith.

9. The trash can assembly of claim 8, wherein the sealing member is at least partially coupled to an outer surface of a respective can.

10. The trash can assembly of claim 8, wherein the sealing member being at least partially enclosed with a protective member such that the sealing member is positioned between a respective can and the protective member, the sealing member configured to be displaceable between the protective member and a respective can, the sealing member configured such that a respective opening is capable of being substantially covered therewith.

11. The trash can assembly of claim 6, wherein the first inner seal is positioned at a bottom section of the inner can.

12. The trash can assembly of claim 6, further comprising a trash bag, the trash bag configured to be positioned within the first space.

13. The trash can assembly of claim 12, wherein the trash bag is operably coupled to the inner can such that a substantially air-tight seal is formed between the trash bag and an upper section of the inner can.

14. The trash can assembly of claim 12, wherein the trash bag is coupled to the inner can with a second inner seal.

15. The trash can assembly of claim 14, wherein the second inner seal is positioned on an upper section of the inner can.

16. The trash can assembly of claim 14, wherein the second inner seal is an elastic member.

17. The trash can assembly of claim 6, wherein the inner opening is positioned on a bottom portion of the inner can.

18. A method of using a trash can assembly, comprising the steps of:

positioning a trash bag within a first space of an inner can such that a substantially air-tight seal is formed between the trash bag and the inner can, the inner can comprising: a first inner seal circumscribing an outer surface of the inner can, an inner opening exposing the first space, and an inner valve configured to close and expose the inner opening; and positioning the inner can substantially completely within a second space of an outer can, the outer can comprising: a plurality of vertical sides and a horizontal bottom plane, with the vertical sides and the horizontal bottom plane forming the second space therebetween, with the horizontal bottom plane having a horizontal central region with an outer opening extending through the horizontal central region, and with an outer valve horizontally oriented and positioned on the horizontal central region of the horizontal bottom plane, the outer valve configured to close and expose the outer opening;

wherein the first inner seal is configured such that a substantially air-tight seal is formed between the first inner seal and the outer can; and wherein the inner valve is closed when the outer valve is opened, and the inner valve is opened when the outer valve is closed.

19. The method of claim 18, further comprising the step of:

pulling the inner can away from the outer can such that the inner valve is opened and the outer valve is closed, thereby transferring air from the first space to the second space.

20. The method of claim 19, further comprising the step of:

pushing the inner can into the outer can such that the inner valve is closed and the outer valve is opened, thereby transferring air from the second space to the atmosphere.

* * * * *